US005343724A

United States Patent [19]

Sornes

[11] Patent Number: 5,343,724

[45] Date of Patent: Sep. 6, 1994

[54] LOCK ARRANGEMENT EMPLOYING MECHANICALLY ACTING CODE CARD AND KEY CARD

[75] Inventor: Tor Sornes, Moss, Norway

[73] Assignee: Trioving a.s, Norway

[21] Appl. No.: 59,114

[22] Filed: May 7, 1993

[51] Int. Cl.[5] ..... E05B 35/10; E05B 25/00

[52] U.S. Cl. ..... 70/340; 70/352; 70/383; 70/386

[58] Field of Search ..... 70/352, 385–387, 70/405, 395, 340–343, 350, 351

[56] References Cited

U.S. PATENT DOCUMENTS

| | | | |
|---|---|---|---|
| 2,176,800 | 10/1939 | Moninger | 70/341 |
| 3,293,893 | 12/1966 | Chesler | 70/385 |
| 3,599,456 | 8/1971 | Bessim | 70/341 X |
| 4,149,394 | 4/1979 | Sornes | 70/352 |
| 4,452,059 | 6/1984 | Sornes | 70/352 X |
| 4,836,002 | 6/1989 | Monahan | 70/385 X |
| 5,025,647 | 6/1991 | Muus | 70/352 |
| 5,181,407 | 1/1993 | Wu | 70/352 X |

*Primary Examiner*—Peter M. Cuomo
*Assistant Examiner*—Suzanne L. Dino
*Attorney, Agent, or Firm*—Lucus & Just

[57] ABSTRACT

In a locking apparatus that utilizes bores and blocking pins along with key cards and code cards to unlock the lock, a master card key is employed with holes in all of the master card bores and balls are used instead of blocking pins.

1 Claim, 5 Drawing Sheets

LOCK ARRANGEMENT EMPLOYING MECHANICALLY ACTING CODE CARD AND KEY CARD

FIELD OF THE INVENTION

The present invention relates to a lock apparatus comprising a housing, a locking member, blocking pins which, by means of a substantially platelike key member are movable in bores between two positions wherein they prevent and permit, respectively, relative motion between the locking member and the housing, the combination of the lock being determined by a substantially platelike code member.

BACKGROUND

Such locks are of special interest for hotels, where it is not uncommon that the guests forget to leave the key upon departure or that the key is lost in some other way. For security reasons, it will be desirable to change the combination of the lock to a new key. Also a number of other institutions will have similar requirements.

Conventionally, these locks have a lock housing in which there are at least two slots, a code member slot and a key member slot. The lock housing also contains a locking member and a series of blocking pins which are arranged perpendicular to the two slots and which prevent the opening of the lock when the proper key member is not used. In order to insert the key member into the lock housing there is an opening in the exterior of the lock, the opening being aligned with the key member slot. Locks of this type are generally of two varieties, magnetic and mechanical.

The magnetic lock systems are known from U.S. Pat. Nos. 3,271,983 and 3,661,763. Here the blocking pins consist of rod magnets which are movably arranged between the key and code members. The blocking pins may be moved axially to releasing position by corresponding magnetized sections on the key and code members. Since in these locks the blocking pins may be moved only by means of magnetic forces which are relatively weak, dust and other foreign matter can reduce the movability of the blocking pins to such an extent that they cannot be moved sufficiently by the magnetic sections on, for instance, the key member in order for the lock to be opened. This problem is aggravated by the fact that iron-containing dust will be attracted by the blocking pins. In addition, there is the possibility of unintentional de- or re-magnetization of the key member so that it may no longer be used to open the lock. Furthermore, it is relatively costly to change the combination of the lock because the key and code members are relatively expensive to manufacture, due to the necessary magnetizing equipment. Finally these locks do not possess the desired resistance to picking.

In the mechanical variety, the blocking pins are mechanically affected by the key and code member, such that the combined thickness of the code and key members at the positions coinciding with the axes of the blocking pins effects the movement of the blocking pins to permit or prevent opening of the lock.

The proper overlay of the key member and code member produces a matrix of holes which causes the blocking pins to be aligned such that the lock is in an open position. An improper overlay of the key member and the code member prevents the lock from being in an open position. Such a mechanical lock system is taught in U.S. Pat. No. 4,149,394.

It is desirable for a lock apparatus to allow for both a key member and a master key member to be used for effecting opening of the lock. As the name implies, a master key member allows a single key member to be used in a plurality of individual locks.

As taught in the '394 patent, the master key member requires a separate slot or a second key slot different from the slot used for the individual key member and a second opening in the exterior of the lock. A second key slot and second opening not only adds to the cost associated with manufacture of the lock but also to confusion by the user as to into which opening to insert their key member. There is a need for a mechanical lock of the type described above that is able to utilize a master key member without the need of a second key opening and a second key slot. There is also a need to provide a simple means for modifying the internal mechanical workings of locks made in accordance with the teachings of the '394 patent and which only have one slot for key members, both master and individual.

SUMMARY OF THE INVENTION

It has now been discovered that a mechanical lock of the type taught in the '394 patent can be made to provide for the utilization of a master key member without the need of a second key slot. This improvement to the mechanical lock provides economic savings to hotels and the like in two ways.

First, it allows hotels with the one key slot lock system of the '394 patent to be modified to provide for a master key without having to buy a new lock. Second, it allows for a less costly means for manufacturing a lock of the type taught in the '394 patent.

The locking mechanism of the present invention replaces some of the lower block pins in the locking member with balls. By employing balls in the locking member in place of some of the lower blocking pins, a master key card need not depress each of the upper blocking pins in the lock housing the proper distance in order to allow the lock to be opened. The balls allow the locking member to move within the lock housing even though the ball has not been depressed to align the surface of the ball with the plane that separates the locking member from the lock housing.

In a preferred embodiment of the present invention, the ball and the cylinder-shaped upper blocking pin in the lock housing is eliminated in all bores and replaced with a bullet-shaped upper blocking pin having a semicircular top.

BRIEF DESCRIPTION OF THE DRAWINGS

Further features and advantages of the invention will be apparent from the claims and from the following description of the examplifying embodiment shown on the attached drawings, wherein

DETAILED DESCRIPTION

Figure 1:
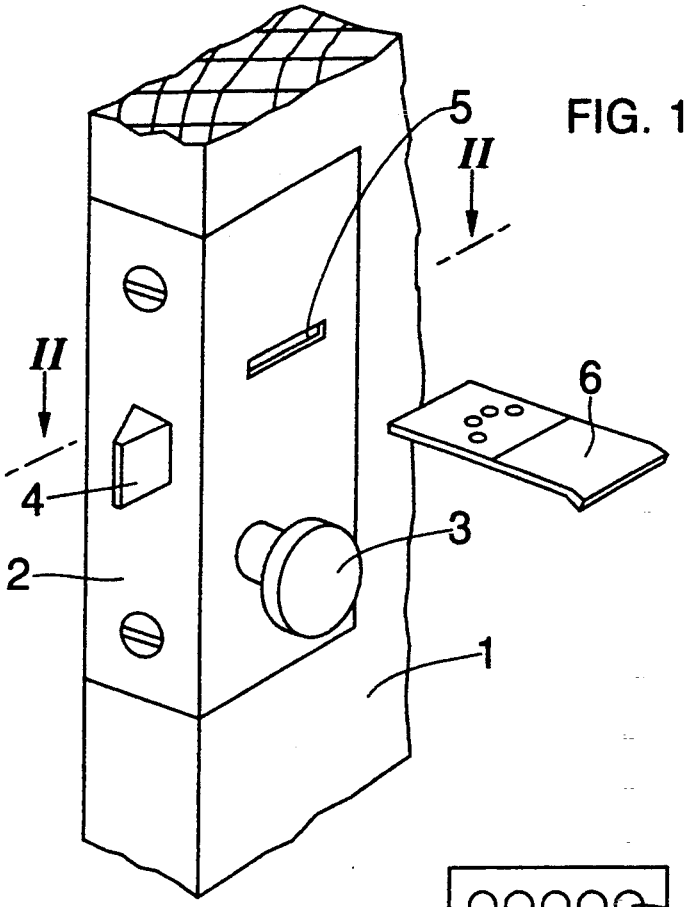
FIG. 1 shows schematically and in perspective a section of a door with a lock according to the present invention and a key card.

FIG. 1 schematically shows the section of a door 1 which is equipped with a lock box 2 having a knob 3 and a latch bolt 4. Furthermore, the lock box has a single external slot 5 for a key card 6.

Figure 2:
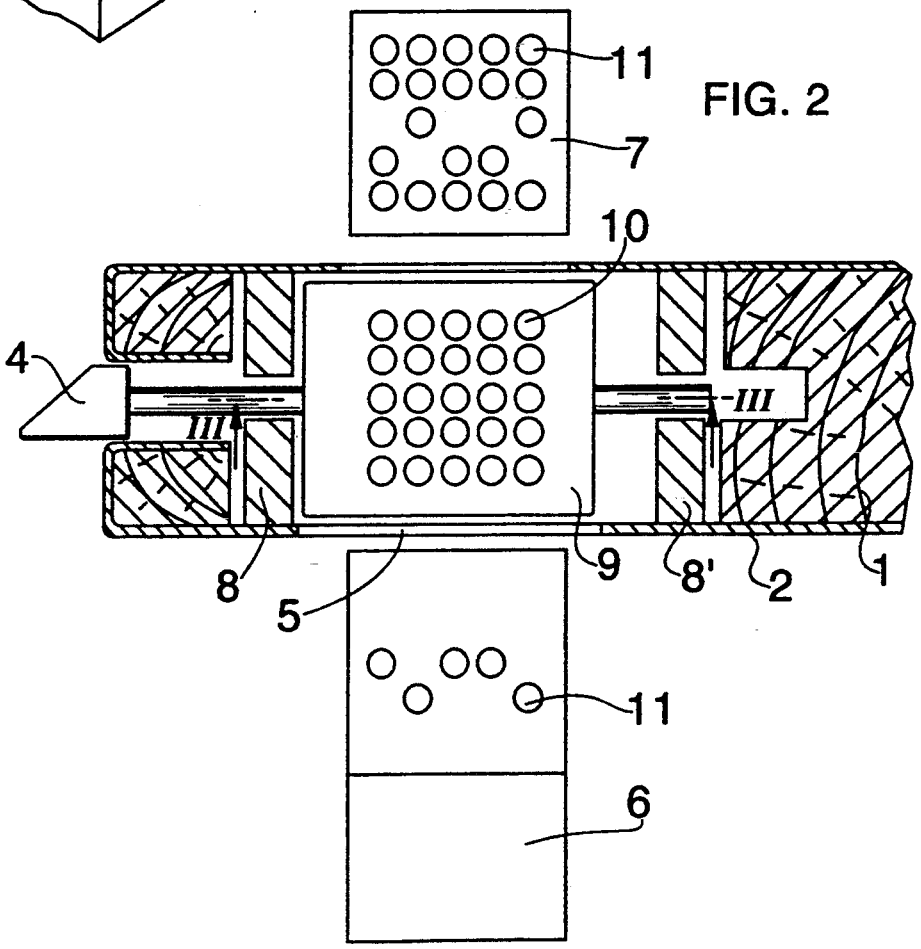
FIG. 2 is a horizontal section taken along line II—II in FIG. 1 through the door and lock with the code card and key card outside the lock.

FIG. 2 is a horizontal section taken on line II—II through the door 1 with the lock box 2. Here, also a code card 7 is shown outside the lock. In the lock box 2 a lock housing 8 is placed wherein a locking member 9 is slidably arranged. The locking member 9 is attached to the latch bolt 4. The locking member 9 is equipped with vertical, dead end bores 10 which are arranged in a 5×5 matrix. It will be appreciated by those of skill in the art that such a matrix may contain a different number and arrangement of dead end bores. Good results, in accordance with the present invention, have been obtained with the matrix pattern containing 32 dead end bores in a pattern shown in FIG. 9.

The key card 6 and code card 7 are equipped with holes 11 which are placed in a matrix corresponding to the bores 10 of the locking member 9. It will be apparent that the holes of the key card supplement the holes of the code card so that these together form a complete matrix, i.e. the key card has holes where the code card does not have holes, and vice versa. If the key card is placed on top of the code card, the thickness of the total unit at the bores 10 is different from the combined thickness of the unit in the remaining places. Namely, at the bores, there will be a single thickness of card material whereas outside the bores there will be two superposed thicknesses of card material.

Figure 3:
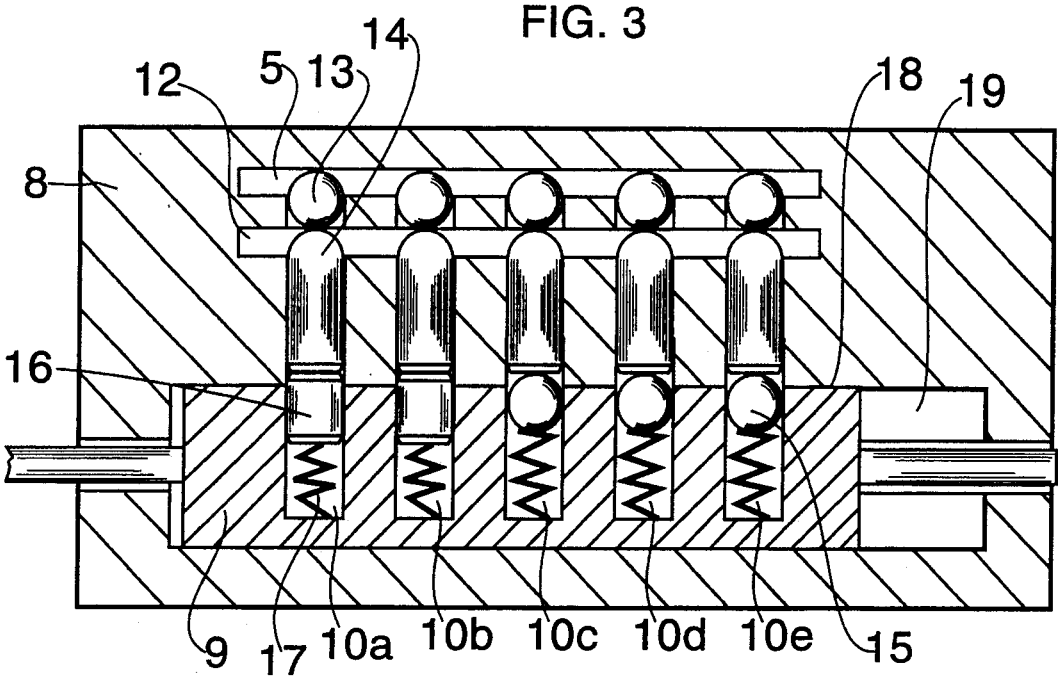
FIG. 3 shows an enlarged vertical section taken along line III—III in FIG. 2 through the lock without the code card and key card.

FIG. 3 is a vertical section through a lock housing 8 and the locking member 9 along line III—III of FIG. 2. Thus, this section shows the five central bores in the locking member, the bores being designated 10*a*–10*e*. It will be apparent that these bores continue upward into corresponding deadend bores in the lock housing 8. The deadend bores in the lock housing 8 terminate in a transverse slot 5 for the key card 6. Furthermore, the bores in the lock housing are intersected by a slot 12 for the code card 7.

Each of the bores in the lock housing contain one upper ball 13 which is positioned between slot 5 and slot 12 and one upper blocking pin 14 positioned between slot 12 and locking member 9. It is preferred that the upper blocking pin 14 is shaped like a bullet with the rounded head of upper blocking pin 14 in contact with upper ball 13, as shown in FIG. 3. Each of the bores in the locking member 9 contains either lower ball 15 or lower blocking pin 16. In FIGS. 3–8 there are two cylindrical shaped blocking pins 16 and three balls 15. The blocking pins and the balls are pressed upwards in the bore by coil spring 17.

When the lock housing 8 contains neither the code card nor the key card, the lower balls 15 and the lower blocking pins 16 will intersect the separating plane 18 between the top surface of the locking member 9 and the upper surface in an inner cavity 19 in the lock housing. Thus, the lower blocking pins 16 will prevent the locking member 9 from moving in the cavity 19.

Figure 4:
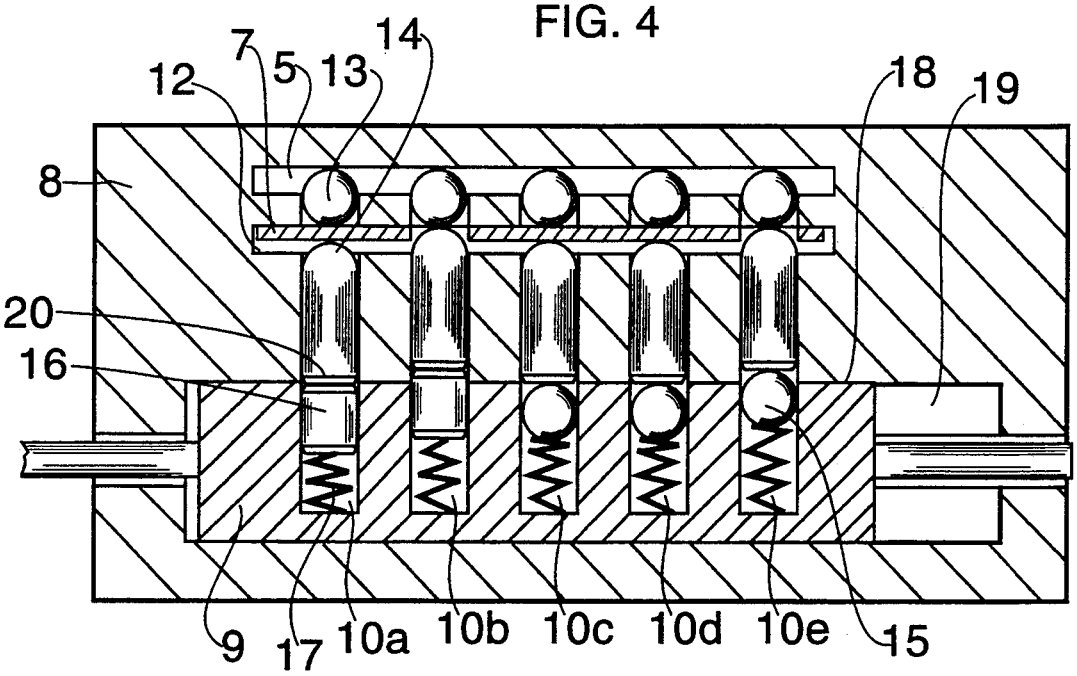
FIG. 4 shows the same section as FIG. 3 but with the code card inserted.

FIG. 4 shows the lock with a code card 7 inserted in the slot 12. The code card has holes coinciding with the bores 10*b* and 10*e*, and the blocking pin 16 in bore 10*b* therefore assumes the same blocking position in bore 10*b* as shown in FIG. 3. However, the code card does not have holes for the bores 10*a*, 10*c* and 10*d*. In bores 10*a*, 10*c* and 10*d*, the code card presses the ball 13 and the rounded head of upper blocking pin 14 apart a distance corresponding to the thickness of the code card, and this thickness is selected such that the separation plane 20 between the blocking pins 14 and 16 in bore 10*a* and separation plane 20 between lower ball 15 and upper blocking pin 14 in bores 10*c* and 10*d* coincide with the separation plane 18 between the locking member and the lock housing. The blocking pins in the bores 10*a*, 10*c*, and 10*d* therefore will have no blocking influence on the locking member while the lower blocking pin 16 in bore 10*b* will continue to have a blocking influence. The lower ball 15 in bore 10*e* will also have no blocking effect because the round nature of the ball will allow locking member 9 to slide in cavity 19.

Figure 5:
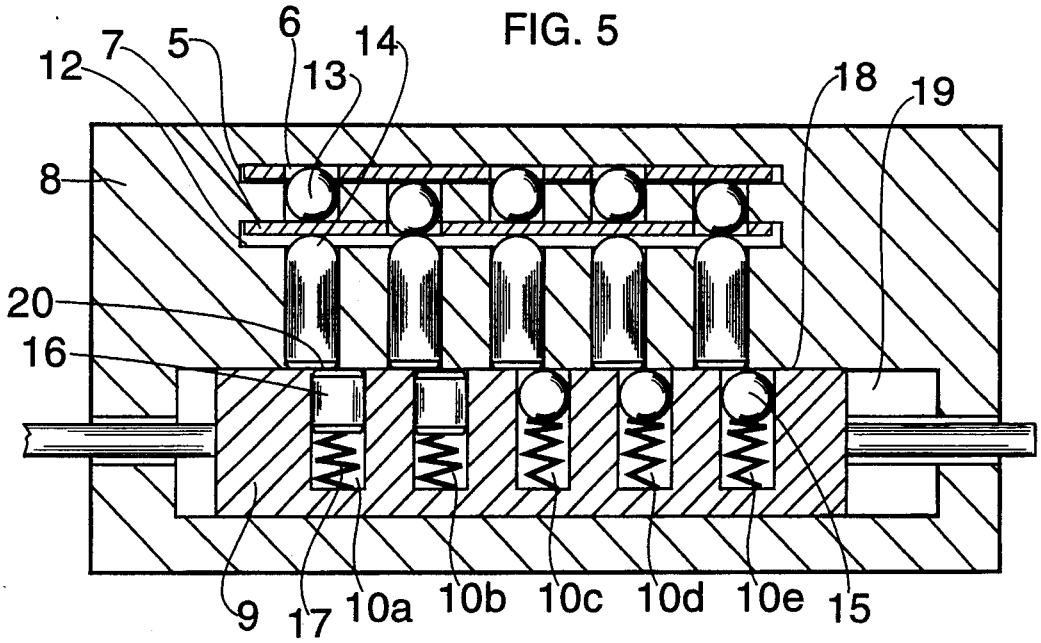
FIG. 5 shows the same section as FIG. 4 but with both code card and key card inserted.

FIG. 5 shows the condition of the lock following the insertion of a key card 6 in the slot 5. Since the key card 6 has holes where the code card 7 does not have any, the key card will not affect the blocking pins in the bores 10*a*, 10*c* and 10*d*. Thus, their separating plane 20 remains coincident with the separating plane 18 in bores 10*a*, 10*c* and 10*d*. However, the key card 6 does not have holes for the remaining bores 10*b* and 10*e*, and since the key card 6 here has the same thickness as the code card, the key card will press the balls 13, 15 and the blocking pins 14, 16 in bores 10*b* and 10*e* downwards sufficiently for the separating plane 20 between the blocking pins 14 and 16 of bore 10*b* to coincide with the separating plane 18 between the locking member and the lock housing. Thereby the separating plane 20 of all the pin pairs in bores 10*a* and 10*b* will coincide with the separating plane 18, and the locking member 9 may be moved freely towards the right as shown in FIG. 5. The motion of the locking member may be effected in any suitable manner, and results in the withdrawal of the latch bolt 4 so that the door 1 may be opened.

It will be apparent that the slot 12 for the code card has a height which is at least equal to twice the thickness of the code card. The code card will thus have the possibility of temporarily assuming a lower position during the insertion of the key card 6.

Figure 6:
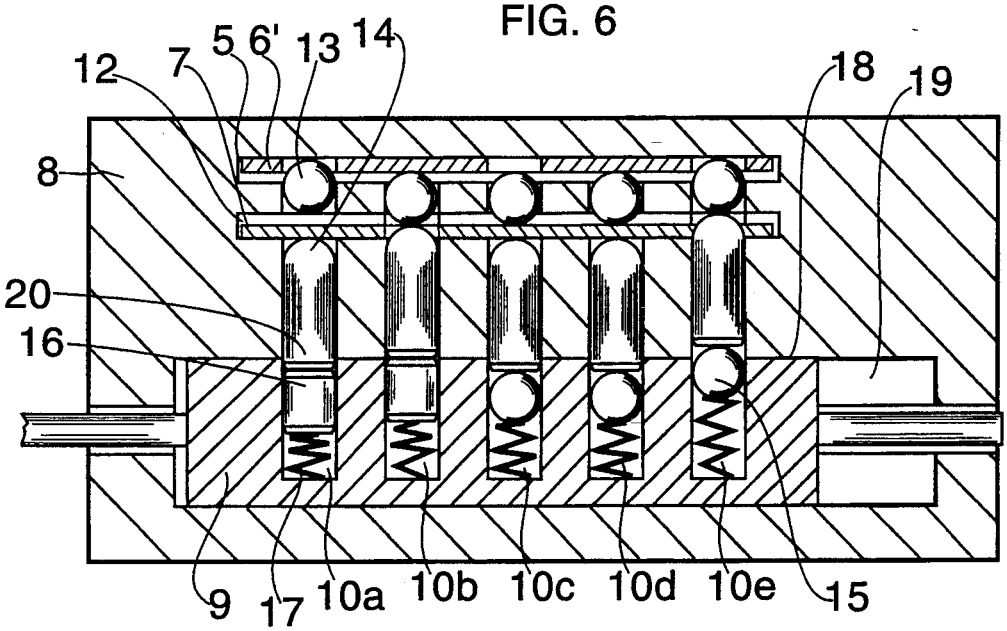
FIG. 6 shows the same section as FIG. 5 but with an incorrect key card inserted.

FIG. 6 shows what will happen to the lock in FIG. 4 if an incorrect key card 6' is inserted in the slot 5. The incorrect key card 6' has the right hole combination for the bores 10*a*, 10*b* and 10*c* but the remainder 10*d* and 10*e* are wrong. However, it will be seen that for only one of the bores, namely 10*b*, will the separating plane 20 between the pins coincide with the separating plane 18. For bores 10*a*, 10*c* and 10*d* the upper blocking pin 14 is forced down into locking member 9 and will block the movement of locking member 9. This is a result of the blocking pin 14 and lower blocking pin 16 in bore 10*a* and blocking pin 14 and ball 15 in bores 10*c* and 10*d* being depressed by code card 7 which assumes a lower position because the incorrect key card 6' lacks a hole for the bore 10*d*.

Figure 7:
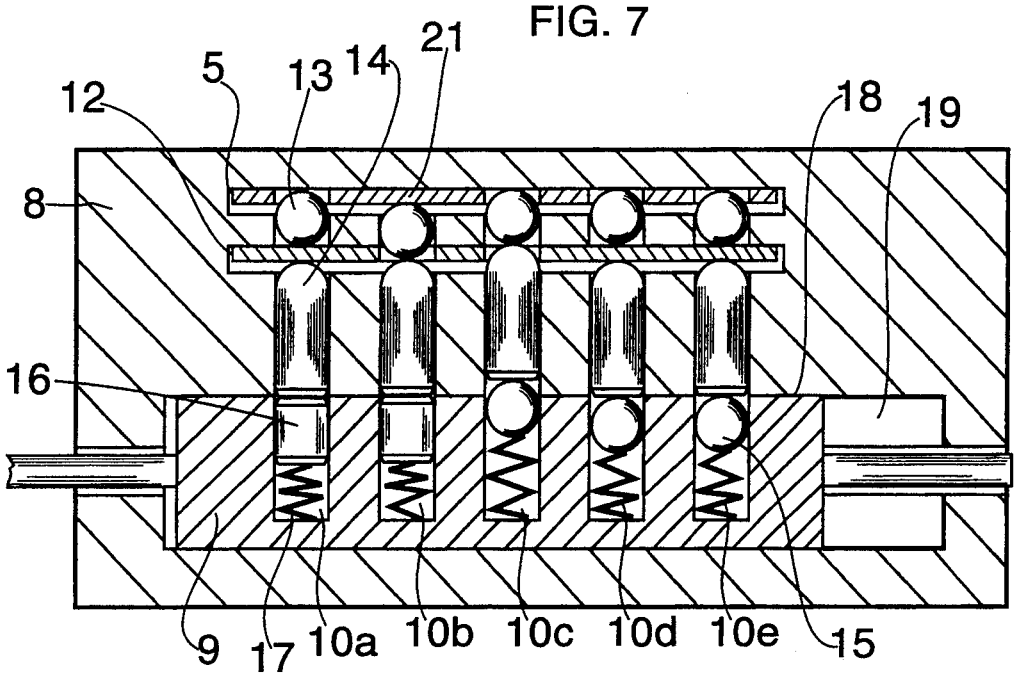
FIG. 7 shows the same section as FIG. 6 but with a master key member inserted.

FIG. 7 illustrates how the master key card works in accordance with the present invention. In this case, master key card 21 is inserted into slot 5 and has holes which correspond to the bores which contain lower ball 15. Thus, master key card 21 contains holes corresponding to bores 10*c*, 10*d* and 10*e*. Master key card 21 also contains a combination of holes/no holes opposite to the holes/no holes combination of code card 7 in bores 10*a* and 10*b*. In the master key card 21 in the lock as shown in FIG. 7, the alignment of the five bores is not correct as ball 15 in bore 10*c* is protruding into the lock housing 8. Fortunately, this is a ball and when locking member 9 is moved, the ball will not block the movement but be pressed into the locking member 9.

Figure 8:
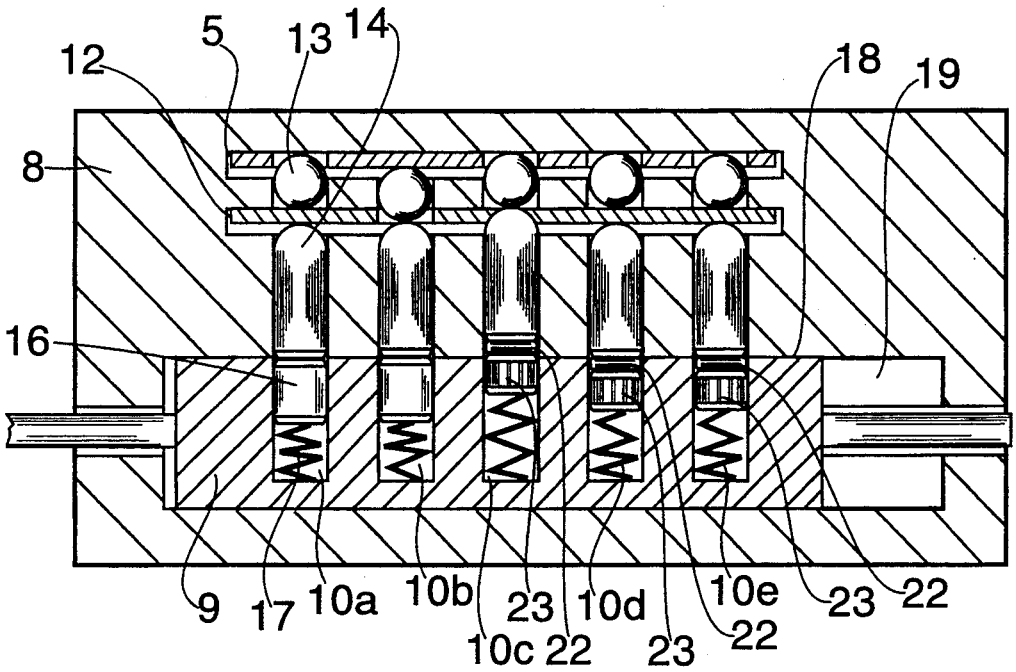
FIG. 8 shows the same section as FIG. 7 but with the ball members in the locking member replaced with a disc and a shorter blocking pin.

Another type of master key system made in accordance with the present invention uses a combination of small lower blocking pins and discs instead of balls. This type is shown in FIG. 8 wherein the three bores 10*c*, 10*d* and 10*e* have discs 22 and a small lower blocking pin 23, smaller than lower blocking pin 16. A similar result is obtained as shown in the previous system with balls. The discs 22 have a thickness equal to the thickness of the code card.

It will be appreciated by those of skill in the art that the master key card made in accordance with the present invention has holes corresponding to each bore in which there is a lower ball 15 or, in the case of FIG. 8, a disc 22. Additionally, the master key card has a hole/no hole pattern opposite the hole/no hole pattern of the code card.

Figure 9:
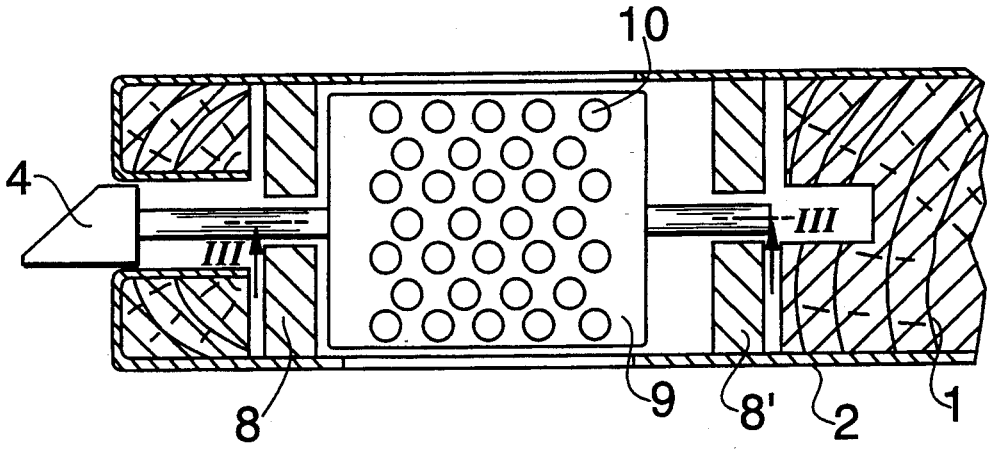
FIG. 9 shows a horizontal section taken along line II—II in FIG. 1 through the door and the lock.

In another preferred embodiment of the present invention, there are 32 vertical dead end bores; FIG. 9 illustrates a lock with such an arrangement. If we designate 10 of these 32 bores as bores for lower ball 15 or disc 22 and utilize 5 of the 10 bores, then there will be 252 possible different master key card combinations. This will leave 32 minus 10 or 22 bores left for individual room key codes which provides 2 in the power of 22 or 262144 different individual room key cards.

It will be apparent from the preceding examples that according to the invention the lock may be converted to a new combination by simply exchanging the old code card with a new one. The code card may be made in a simple manner from inexpensive material like plastic, cardboard or metal. The corresponding key card may advantageously be made from the same material as the code card.

The lock may be designed so that the code card only may be introduced in its slot from the inside of the door. Only persons having access to the room will thus be able to exchange the code card and thereby invalidate the key card previously used. Access to the code card may also be blocked in other ways, for instance by means of a separate locked shutter on the inside of the door so that two keys will have to be used to gain access to the code card. Where special security requirements dictate the necessity of having two persons present for opening the door, the lock may be designed so that both the code card and the key card have to be inserted from the outside of the door.

For a skilled person, it will be clear that according to the invention there is provided a lock which is of a very simple design and which contains very few different parts. In the embodiment shown, the blocking pins 14 and 16 are of different length, but it would be but a simple matter to change the dimensions of the lock housing in order to make these blocking pins of similar length. Additionally, blocking pin 14 can be replaced by a ball and a blocking pin wherein the ball resembles the rounded head of the blocking pin.

For a skilled person, it will furthermore be clear that the lock according to the invention gives a very large number of different key combinations and that this number easily may be increased by arranging more blocking pin bores. In the embodiment shown, the matrix of the bores is square and symmetrical, the result being that one and the same key may be used for two different combinations by turning the key upside-down. In order to avoid such a reduction of possible combinations, it is suggested according to the invention to arrange the positions of the matrix in a non-symmetric fashion with respect to the center line of the key card. The same may be done for the code card.

It will be understood that the claims are intended to cover all changes and modifications of the preferred embodiments of the invention herein chosen for the purpose of illustration which do not constitute a departure from the spirit and scope of the invention.

What is claimed is:

1. In a lock apparatus having a lock housing and a locking member slidable in said lock housing between a locked and an unlocked position and a plurality of bores in both said lock housing and said locking member which are aligned when said lock apparatus is in a locked position, a plate-like code member having regions corresponding to said bores, at least one of said regions having a hole therein, a plate-like key member having regions corresponding to said bores, said regions having holes therein corresponding to said regions of said plate-like code member having no holes therein, the improvement comprising:

a bullet-shaped upper blocking member positioned in each of said bores in said lock housing;

each said bore having either a lower blocking pin or a lower ball therein, with at least one said bore having said lower blocking pin;

a spring means acting to push said lower blocking pin or said lower ball against the bottom of said bullet-shaped upper blocking pin;

a plate-like master member having regions corresponding to said bores, said regions having holes corresponding to said bores having lower balls and the same combination of holes or no holes as said plate-like code member for said bores having lower blocking pins.

* * * * *